US006871362B1

(12) United States Patent
Zell

(10) Patent No.: US 6,871,362 B1
(45) Date of Patent: Mar. 29, 2005

(54) POOL COVER SPOOL

(76) Inventor: Lothar J Zell, 8206 Babsdale Chase, Montgomery, AL (US) 36117

( * ) Notice: Subject to any disclaimer, the term of this patent is extended or adjusted under 35 U.S.C. 154(b) by 0 days.

(21) Appl. No.: 10/446,211

(22) Filed: May 27, 2003

(51) Int. Cl.[7] ..... E04H 4/00
(52) U.S. Cl. ..... 4/502
(58) Field of Search ..... 4/502, 503; 242/395

(56) References Cited

U.S. PATENT DOCUMENTS

| | | | | |
|---|---|---|---|---|
| 951,718 A | | 3/1910 | Arnsdorff | |
| 1,484,587 A | | 3/1924 | Best | |
| 3,070,811 A | | 1/1963 | Bender | |
| 3,091,414 A | | 5/1963 | Patnaude | |
| 4,179,080 A | | 12/1979 | Patnaude | |
| 4,324,370 A | * | 4/1982 | Guard et al. | 242/403 |
| 4,328,930 A | | 5/1982 | Kalendovsky | |
| 4,407,027 A | * | 10/1983 | Colon, Jr. | 4/502 |
| 4,459,711 A | * | 7/1984 | Sartain et al. | 4/502 |
| 5,259,078 A | * | 11/1993 | Crandall | 4/503 |
| 5,425,143 A | | 6/1995 | Kalandovsky | |
| 5,636,808 A | * | 6/1997 | Colin | 242/395 |
| 5,701,613 A | | 12/1997 | Richardson | |
| 6,026,522 A | | 2/2000 | Last | |
| 6,618,869 B1 | * | 9/2003 | Jacobs | 4/502 |

FOREIGN PATENT DOCUMENTS

GB 2179627 A * 3/1987

* cited by examiner

*Primary Examiner*—Charles E. Phillips
(74) *Attorney, Agent, or Firm*—Michael I. Kroll

(57) ABSTRACT

The present invention 10 discloses a pair of end heads 28, 30 that are interconnected onto the inwardly disposed tube assembly 26 to form the pool cover 12 storage reel. Hand wheels 32 are rotationally attached to tube assembly 26 by end tubes 36 on the outside of the end heads 28, 30. Each of the end heads 28, 30 includes a pair of casters 40 mounted to the bottom surface of the end head. The tube assembly 26 consists of five components, a center tube 34, two outer tubes 36 and two end caps 42. The center tube is of larger diameter and allows for the two outer tubes to be telescopically inserted into the opposing distal ends. The cylindrically shaped tubes include mating male 48 and female 46 extrusions along the surfaces to ensure joint rotational movement of the tube assembly. The telescoping tubes 26 include a series of holes 38 along the surface creating cavities and providing convenient and efficient means to store the straps, springs or other anchoring means that are positioned around the perimeter of the covering.

10 Claims, 18 Drawing Sheets

POOL COVER SPOOL

BACKGROUND OF THE INVENTION

Field of the Invention

The present invention relates generally to pool covers, and, more specifically, to a pool cover reel suitable for installation and removal of an in ground pool safety cover.

Pool covers are often utilized to reduce maintenance, provide safety and for support of heat retention. Yet, installation and removal of a pool cover can be painstaking and troublesome often requiring 2 or more people to properly secure or remove.

Disclosed within is an improved reel that facilitates the transporting of pool covers, tarpaulins, and such materials used to cover areas to be protected. In particularly, pool covers, tarpaulins, and such materials that utilize straps, springs or other anchoring means around the perimeter of the covering.

The present invention consists of a pair of end heads that are interconnected on the inward section by a tube assembly to form the pool cover storage assembly. Hand wheels are rotationally attached to the outward section of the end heads. Each of the end heads includes a pair of casters mounted to the bottom surface of the end head. The casters provide for quick and easy lateral movement of the pool cover storage assembly allowing for proper positioning and facilitating the transport of the pool cover storage assembly to and from the poolside.

The tube assembly consists of five components, a center tube, two outer tubes and two end caps. The three-part tube assembly provides for means to extend or retract the tube length to ensure proper pool cover length. The recessed cotterpins provide a rigid tube assembly as the cover is being rolled up and maintain symmetrical positioning of the center tube. The center tube is of larger diameter and allows for the two outer tubes to be inserted into the opposing distal ends.

The cylindrically shaped tubes include male and female extrusions along the surfaces to ensure joint rotational movement of the tube assembly. The end caps are positioned at both ends of the outer tubes and facilitate a cylindrical bearing surface.

The end heads include a molded cylindrical sleeve on the horizontal plane that allows for the rotational motion of the tube assembly and hand wheel. With end caps secured to the ends of the tube assembly, the tube assembly is inserted into the sleeves of the end heads. The tube assembly is positioned such that a portion of the end cap protrudes through the end head sleeve allowing the hand wheel to be mounted on the outer side of the end head and thus anchoring the pool cover storage assembly. The extruded contours of the hand wheel, end cap, and tube assembly provide for a rotationally rigid body while allowing for easy axial connection and separation.

The telescoping tubes include a series of holes along the surface creating cavities and providing convenient and efficient means to store the straps, springs or other anchoring means that are positioned around the perimeter of the covering. The cover anchors are inserted into the holes before the cover is rolled around the tubes. The openings extruded into the tubes provide for the anchors to be coiled and stored during non-use. This allows for a pleasing appearance, prevents entanglement, and provides ease of assembly when uncoiled.

By modifying the end caps or adding adapter bushings (i.e. maintaining the same outside diameter but reducing the inside diameter suitable for a smaller tube assembly), the same end heads can also be used to install or remove a solar cover.

DESCRIPTION OF THE PRIOR ART

There are other pool cover storage devices. Typical of these is U.S. Pat. No. 951,718 issued to Julius A. Arnsdorff on Mar. 8, 1910.

Another patent was issued to H. S. Best on Mar. 4, 1924 as U.S. Pat. No. 1,485,587. Yet another U.S. Pat. No. 3,070,811 was issued to E. A. Bender on Jan. 1, 1963 and still yet another was issued on May 28, 1963 to H. A. Patnaude as U.S. Pat. No. 3,091,414.

Another patent was issued to Henry A. Patnaude on Dec. 18, 1979 as U.S. Pat. No. 4,179,080. Yet another U.S. Pat. No. 4,324,370 was issued to Wayne Guard et al. on Apr. 13, 1982. Another was issued to Jiri Kalendovsky on May 11, 1982 as U.S. Pat. No. 4,328,930 and still yet another was issued on Oct. 4, 1983 to George M. Colon, Jr. as U.S. Pat. No. 4,407,027.

Another patent was issued to Jiri Kalandovsky on Jun. 20, 1995 as U.S. Pat. No. 5,425,143. Yet another U.S. Pat. No. 5,636,808 was issued to George M. Colin on Jun. 10, 1997. Another was issued to Cedric D. Richardson on Dec. 30, 1997 as U.S. Pat. No. 5,701,613 and still yet another was issued on Feb. 22, 2000 to Harry J. Last as U.S. Pat. No. 6,026,522.

U.S. Pat. No. 951,718 Inventor: Julius A. Arnsdorff
Issued: Mar. 8, 1910

This invention has to do with the handling and display of linoleums, oil cloths and the like; and it has for its object to provide a device of roller character embodying such a construction that a piece of material may be expeditiously and easily rolled on or off the device, and when the desired the device with the material that is rolled thereon may be conveniently rolled over a floor or other surface without liability of the material being fed off the device or disarranged in any manner.

U.S. Pat. No. 1,485,587 Inventor: H. S. Best
Issued: Mar. 4, 1924

This invention particularly relates to a display rack adapted to be employed in connection with chenilles, carpets, canvas and goods of similar character.

The main object of this invention is to provide an improved display rack upon which a single roll of goods of the character described may be stored in a compact roll, the roll being readily accessible for the purpose of display so that any desired length of goods may be withdrawn from the roll and displayed and either cut off from the roll or returned to the roll.

U.S. Pat. No. 3,070,811 Inventor: E. A. Bender
Issued: Jan. 1, 1963

This invention relates to a cover for swimming pools, and in particular to a flexible cover which may be quickly and easily applied and removed. A pool with no cover protection during periods of non-use presents several difficulties of maintenance, for instance, pollution by such foreign matter as dust, pollen, leaves, insects, and even small animals. A cover may also be saving of life in the case of small children. In another aspect it will tend to inhibit heat transfer and thus retain overnight a reasonable amount of the heat stored in the water by day.

It is an object of this invention to provide a pool cover which is flexible, easily applied, and occupies small space when not in use.

U.S. Pat. No. 3,091,414 Inventor: H. A. Patnaude Issued: May 28, 1963

The invention relates to a dolly for the handling of swimming pools covers, in particular for the removal of a cover from a swimming pool and the replacement of same on the latter.

The object of this invention is to provide a dolly which may be used in pairs, one on each side of the swimming pool, for removal from and replacement of the cover on the latter.

U.S. Pat. No. 4,179,080 Inventor: Henry A. Patnaude Issued: Dec. 18, 1979

Disclosed herein is an improved dolly for transporting tarpaulins or vinyl covers that are to be deployed or retracted over areas to be protected. The improvements consist of providing the cover deployment area with a protective shroud, an improved framework and suspension system, an improved steering arrangement, and a supplemental nesting area for tarpaulin supporting shafts that have been already deployed or are to be deployed.

U.S. Pat. No. 4,324,370 Inventor: Wayne Guard et al. Issued: Apr. 13, 1982

A roller apparatus for winding and unwinding a pool cover is provided which comprises a telescoping roller section which can be adjusted in length, wheel or pedestal supports to support the roller above a pool edge, axle members connecting the roller to the wheel or pedestal supports, the latter containing ball bearings to permit axle rotation and means, such as a crank or motor, connected to one of the axle members for rotating the roller to collect the pool cover, the latter being connected to the roller. Once the pool cover is taken up, the apparatus can be rolled on its wheels, or carried where pedestal supports are used, to a storage area.

U.S. Pat. No. 4,328,930 Inventor: Jiri Kalendovsky Issued: May 11, 1982

A cover system for an outdoor swimming pool including a light-weight cover member, a composite reel member on which the cover is wound as it is removed from a covering position overlying a swimming pool to a storage condition and a pair of supporting stands to each of which one end of the reel member is journaled. The reel itself is composed of at least two tubular end sections each of which has on one end a hub member having an axle which is received in a bearing carried by each stand. The other ends are connected in abutting relation by internal expanding members disposed within the adjacent ends of the tubular members. One or more intermediate sections may be connected between the end sections by similar internal expanding members. Each stand includes a tubular member bent to substantially inverted U-shape to provide a handle member and having divergent terminals which provide two legs. A third leg is provided by a separate angled tubular member attached to the U-shaped member at the portion from which one leg diverges.

U.S. Pat. No. 4,407,027 Inventor: George M. Colon, Jr. Issued: Oct. 4, 1983

In the first embodiment of the apparatus, each end frame of the apparatus has one position at which wheels engage the decking surrounding the pool, and another position at which a braking region engages such deck. In accordance with the method, the operator rolls the apparatus to a desired location when each end frame is in the first-mentioned position, and then tilts each such end frame to the second-mentioned position. He then pulls the pool cover off of the now-stationary frame. In accordance with a second embodiment, each end frame is circular and operates as a wheel when it is desired to move the apparatus. To achieve braking, one edge region of each such wheel is pivoted to expose a chordal braking area. In accordance with the method relative to the second embodiment, the shifting from the rolling mode to the braking mode is effected when the indicated edge regions are at rotated positions such that they do not engage the decking.

U.S. Pat. No. 5,425,143 Inventor: Jiri Kalandovsky Issued: Jun. 20, 1995

A multiple pool cover deployment apparatus includes a portable carriage having a movable frame placed at one end of a pool and a main storage reel rotatably mounted thereon and having pool covers successively wound about the main reel. The apparatus also includes a first storage spool rotatably mounted to the frame adjacent to the main storage reel. The first storage spool has an elongated flexible rope wound thereabout. The apparatus also includes a portable stand placed at an opposite end of the pool across from the portable carriage and a second storage spool rotatably mounted on the portable stand. The rope is interconnected by a connector to a leading end of the outer pool cover and a leading portion of the rope is stretched across the pool and connected to the second storage spool for winding thereabout by rotating the second storage spool to cause unwinding of the outer pool cover from the main storage reel and unwinding of the rope from the first storage spool and concurrent pulling of the outer one of the pool covers and the rope across the pool from the portable carriage to the portable stand. The apparatus further includes an auxiliary storage reel mounted to the frame with a protective cover which can be attached to the last pool cover and would over the multiple pool covers to provide protection against sun radiation.

U.S. Pat. No. 5,636,808 Inventor: George M. Colin Issued: Jun. 10, 1997

A reel bearing assembly for supporting a reel in a support frame, the frame having a circular bearing opening having an axially extending cylindrical surface and radially inwardly extending flange and the assembly also including a specially shaped end cap for the reel which, with the configuration of the opening and flange in the support frame, defines a cavity which both radially and axially confines a bearing cage, the end cap having one or more retaining members which engage the flange on the support frame to hold the assembly together.

U.S. Pat. No. 5,701,613 Inventor: Cedric D. Richardson Issued: Dec. 30, 1997

A roll-up cover for a swimming pool comprises a continuous sheet of flexible reinforced plastic firmly attached to an aluminum roller with a number of reinforced loops at the free end of the plastic. The roller can be turned by a crank or wheel to roll the cover up and a pull with a hooked end is used to unroll the cover by inserting it into one of the reinforced loops and pulling the cover off of the roller. The loop straps on the free end of the cover can be hooked at the end of the pull to keep the cover tight. The entire cover assembly is mounted on wheels so that it is of a portable construction, and it includes a debris removal and collection apparatus. The cover can be made of a plurality of interleaved pivotally connected members which is movable along the edges of a swimming pool by a plurality of rollers, and the cover is strong enough to support an adult or child in the event that they accidentally fall into the pool.

U.S. Pat. No. 6,026,522 Inventor: Harry J. Last
Issued: Feb. 22, 2000

A manually powered swimming pool cover drive for extending and retracting swimming pool covers and which includes a pair of overrunning one way clutch devices for intermittent coupled rotation with and also freewheeling about a drive shaft. A drum rotates with the drive shaft and allows winding of a cover about the drum when retracted from a covered position over a swimming pool. A pair of one way clutches may be trained around a drive shaft and coupled for rotating a cable reel allowing for the winding of cables used to extend a swimming pool cover. The respective pair of overrunning, one-way clutches are reciprocated back and forth respectively in a type of indexing operation, manually and with long lever handles for rotating the drive shafts.

While these dollies and pool covering devices may be suitable for the purposes for which they were designed, they would not be as suitable for the purposes of the present invention, as hereinafter described.

SUMMARY OF THE PRESENT INVENTION

The present invention discloses a pair of end heads that are interconnected on the inward section by a tube assembly to form the pool cover storage assembly or reel. Hand wheels are rotationally attached to the outward section of the end heads. Each of the end heads includes a pair of casters mounted to the bottom surface of the end head. The tube assembly consists of five components, a center tube, two outer tubes and two end caps. The three-part tube assembly provides for means to extend or retract the tube length to ensure proper pool cover length. The center tube is of larger diameter and allows for the two outer tubes to be inserted into the opposing distal ends. The cylindrically shaped tubes include longitudinal mating male and female extrusions along the surfaces to ensure joint rotational movement of the tube assembly. The end heads include a molded cylindrical sleeve on the horizontal plane that allows for the rotational motion of the tube assembly and hand wheel. With end caps secured to the ends of the tube assembly, the tube assembly is inserted into the sleeves of the end heads. The tube assembly is positioned such that a portion of the end cap protrudes through the end head sleeve allowing the hand wheel to be mounted on the outer side of the end head and thus anchoring the pool cover storage assembly. The extruded contours of the hand wheel, end cap, and tube assembly provide for a rotationally rigid body while allowing for easy axial connection and separation. The telescoping tubes include a series of holes along the surface creating cavities and providing convenient and efficient means to store the straps, springs or other anchoring means that are positioned around the perimeter of the covering. The cover anchors are inserted into the holes before the cover is rolled around the tubes. The openings extruded into the tubes provide for the anchors to be coiled and stored during non-use. This allows for a pleasing appearance, prevents entanglement, and provides ease of assembly when uncoiled.

A primary object of the present invention is to provide a pool cover reel that allows for storage of the cover straps, springs or other anchoring means.

Another object of the present invention is to provide a pool cover reel that facilitates various sizes of pool covers.

Yet another object of the present invention is to provide a pool cover reel that has detachable components allowing for attachment of a plurality of covers.

Still yet another object of the present invention is to provide a pool cover reel that has wheels for easy transport.

Another object of the present invention is to provide a pool cover reel that is rigid, yet lightweight for easy handling.

Yet another object of the invention is to provide a pool cover reel that includes male and female extrusions to allow for unison rotational movement of the tube and hand wheel assembly.

Still yet another object of the invention is to provide a pool cover reel that is economical to manufacture.

Another object of the present invention is to provide a pool cover reel that has handles for easy handling.

Yet another object of the invention is to provide a pool cover reel that includes recessed cotterpins to protect the cover from being damaged, provide a rigid tube assembly and maintain the symmetrical positioning of the center tube.

Still yet another object of the invention is to provide a pool cover reel that provides means for modified end caps or adapter bushings attached to the end caps suitable for a smaller diameter tube assembly making the unit suitable for use with both a solid safety cover and solar cover installation and removal.

Additional objects of the present invention will appear as the description proceeds.

The present invention overcomes the shortcomings of the prior art by providing an improved method of pool covering, storage, and interchangeability.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
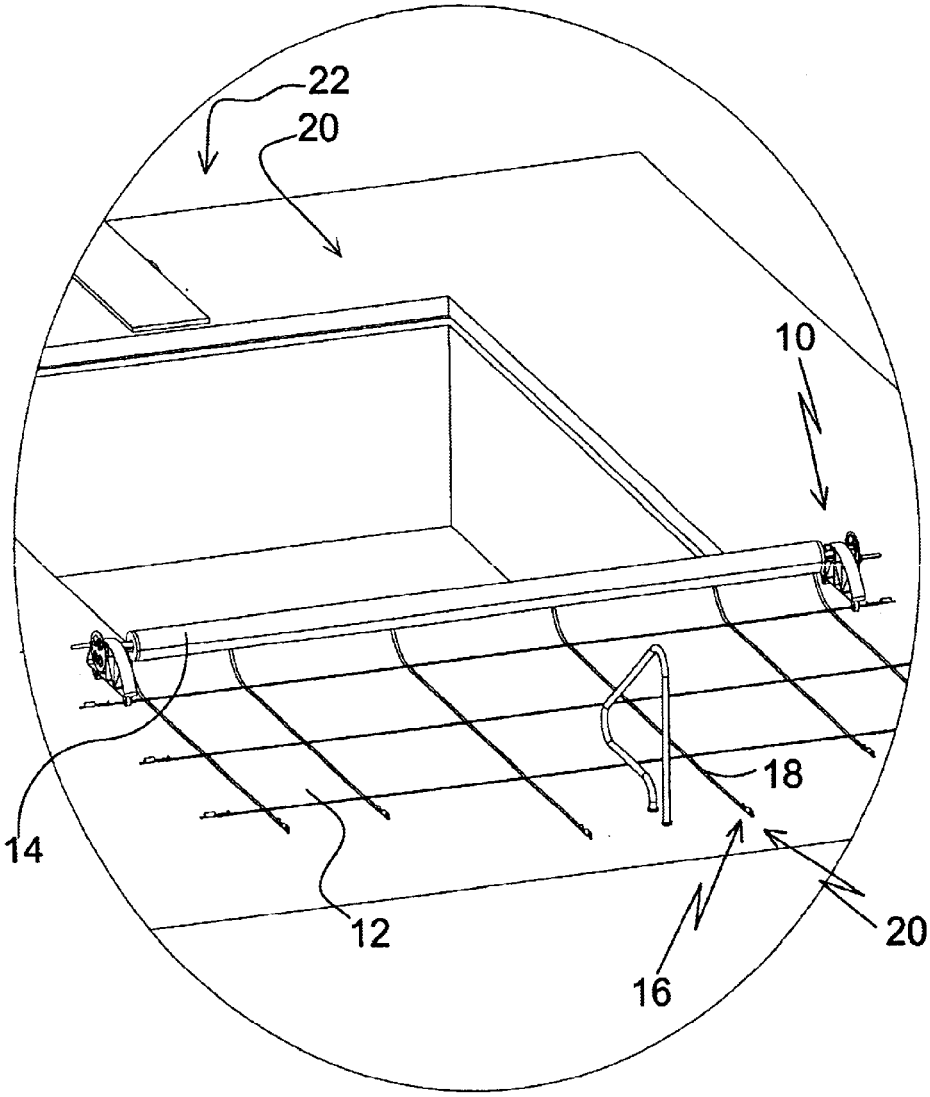
FIG. 1 is a perspective view of a pool cover reel in use.

With regard to reference numerals used, the following numbering is used throughout the drawings.

10 present invention
12 pool cover
14 pool cover roll
16 spring
18 strap
20 anchor
22 pool
24 deck
26 tube assembly
28 right end head
30 left end head
32 hand wheel
34 center tube
36 end tube
38 storage hole
40 caster
42 end cap
44 sleeve for end cap
46 female extrusions
48 male extrusions
50 cavity
52 extrusions
54 handle
56 hand crank
58 hanger
60 recess
62 frame member
64 cotter pin
65 cotter pin apertures
66 solid safety cover
68 solar cover
70 adaptor bushing
72 small diameter tube

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practioners skilled in the art will recognize numerous other embodiments as well. For a definition of the complete scope of the invention, the reader is directed to the appended claims.

Turning to FIG. 1, shown therein is a perspective view of a pool cover reel of the present invention 10 in use. A utilization of the present invention 10 is shown in the early phase of the deployment of a pool cover 12 showing pool cover roll 14. The pool cover 12 is shown partially unrolled as the securing springs 16 on the straps 18 of the cover are hooked on the anchors 20 around the pool 22. The pool cover 12 is rolled open by turning and pushing the reel assembly of the present invention 10 by two operators stationed on each end thereof. The pool cover 12 may be of a variety of types, such as, a solid safety cover, a solar cover or a combination.

Figure 2:
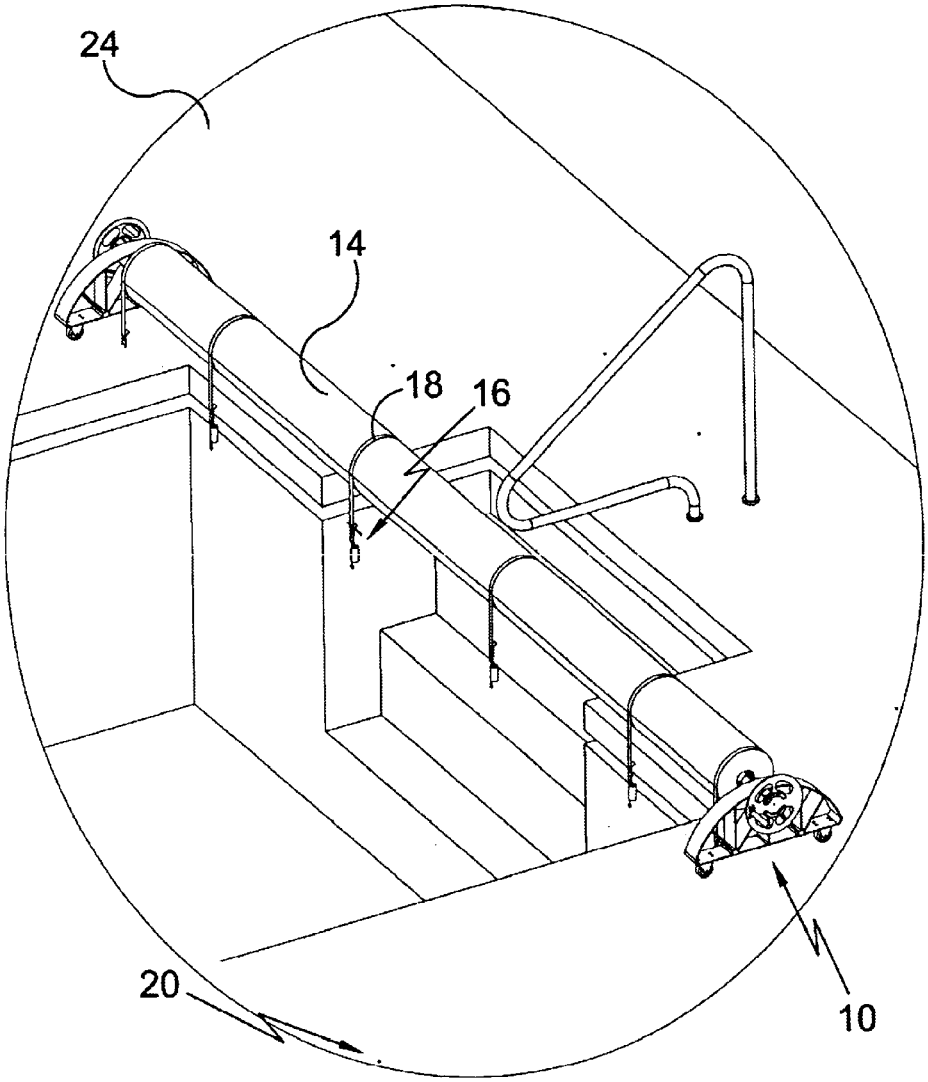
FIG. 2 is a view of a swimming pool cover roll mounted on the reel before the installation.

Turning to FIG. 2, shown therein is a view of a swimming pool cover roll 14 mounted on the reel of the present invention 10 before the installation. The swimming pool cover roll 14 is stored as a whole when not in use. The roll 14 is mounted on the reel of the present invention 10 for storage. Also shown are securing anchor 20, strap 18, spring 16 and the deck 24 of the swimming pool.

Figure 3:
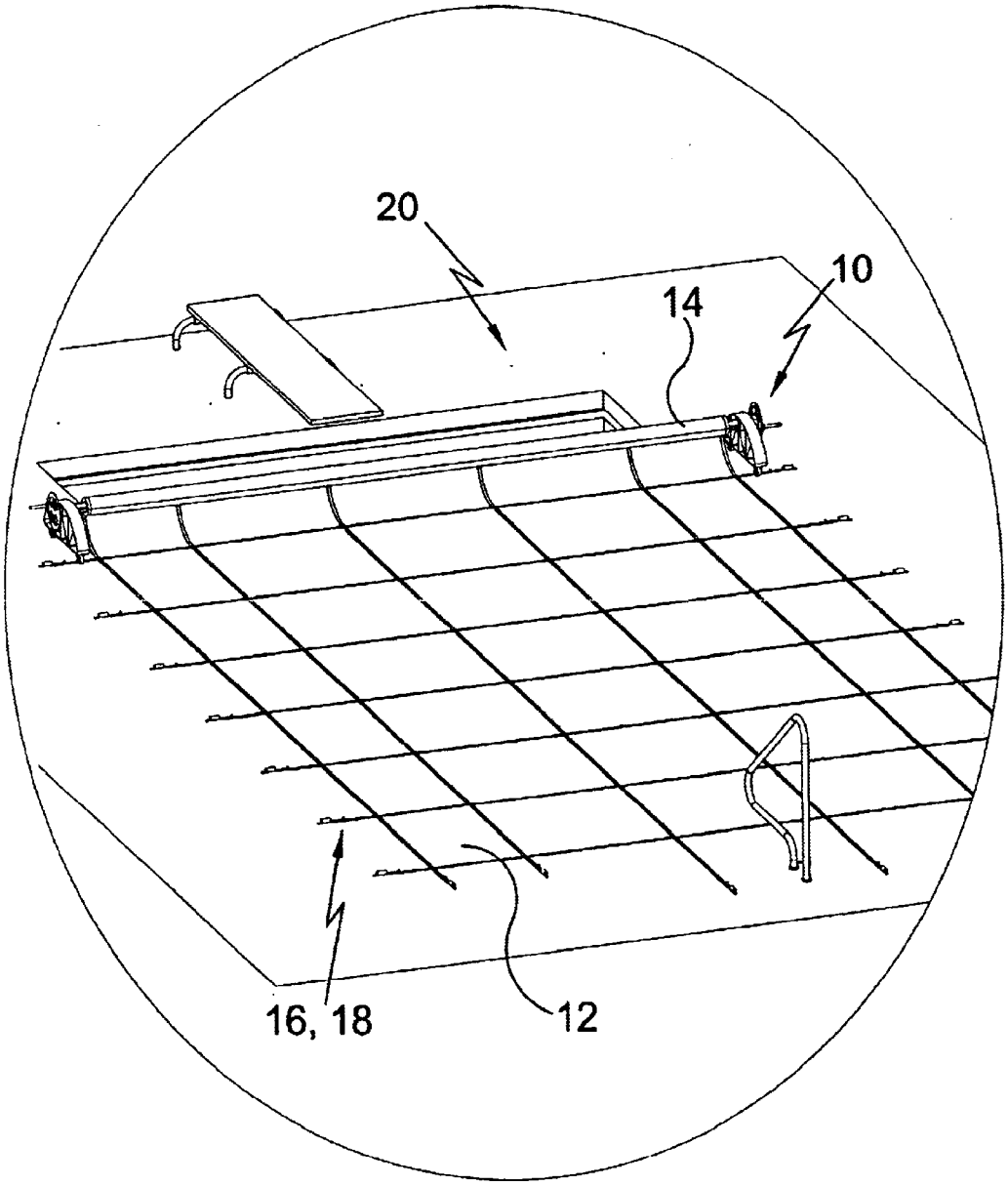
FIG. 3 is a view of the pool cover installation in progress.

Turning to FIG. 3, shown therein is a view of the pool cover 12 and roll 14 showing installation in progress using the present invention 10. Unrolling of the pool cover 12 and securing the straps 18 and springs 16 of the cover 12 on the anchors 20 around the swimming pool continues.

Figure 4:
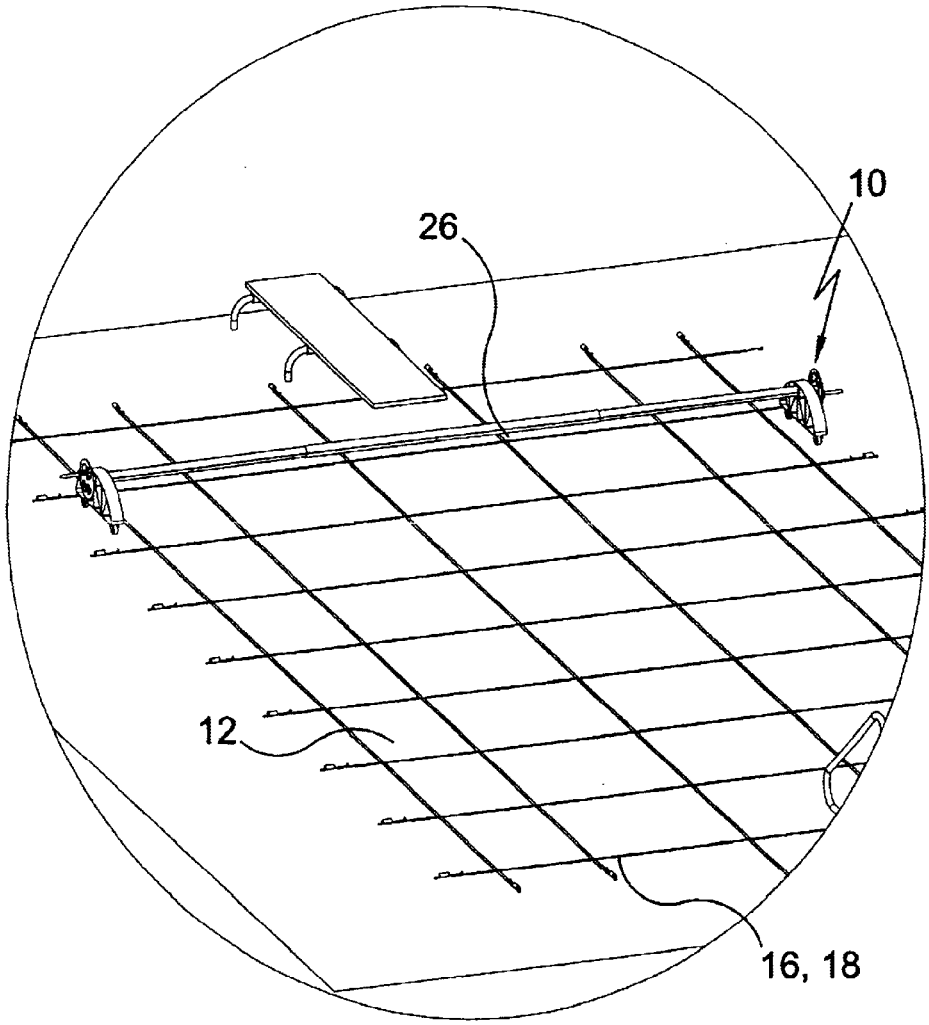
FIG. 4 is a view of the completed pool cover installation.

Turning to FIG. 4, shown therein is a view of the completed pool cover 12 installation using the present invention 10. Shown is the pool cover storage assembly of the present invention 10 after the pool cover installation has been completed. The pool cover 12 was rolled up onto and around the elongated, horizontally disposed tube assembly 26 of the present invention 10. The multiple straps 18 and springs 16 are also shown.

Figure 5:
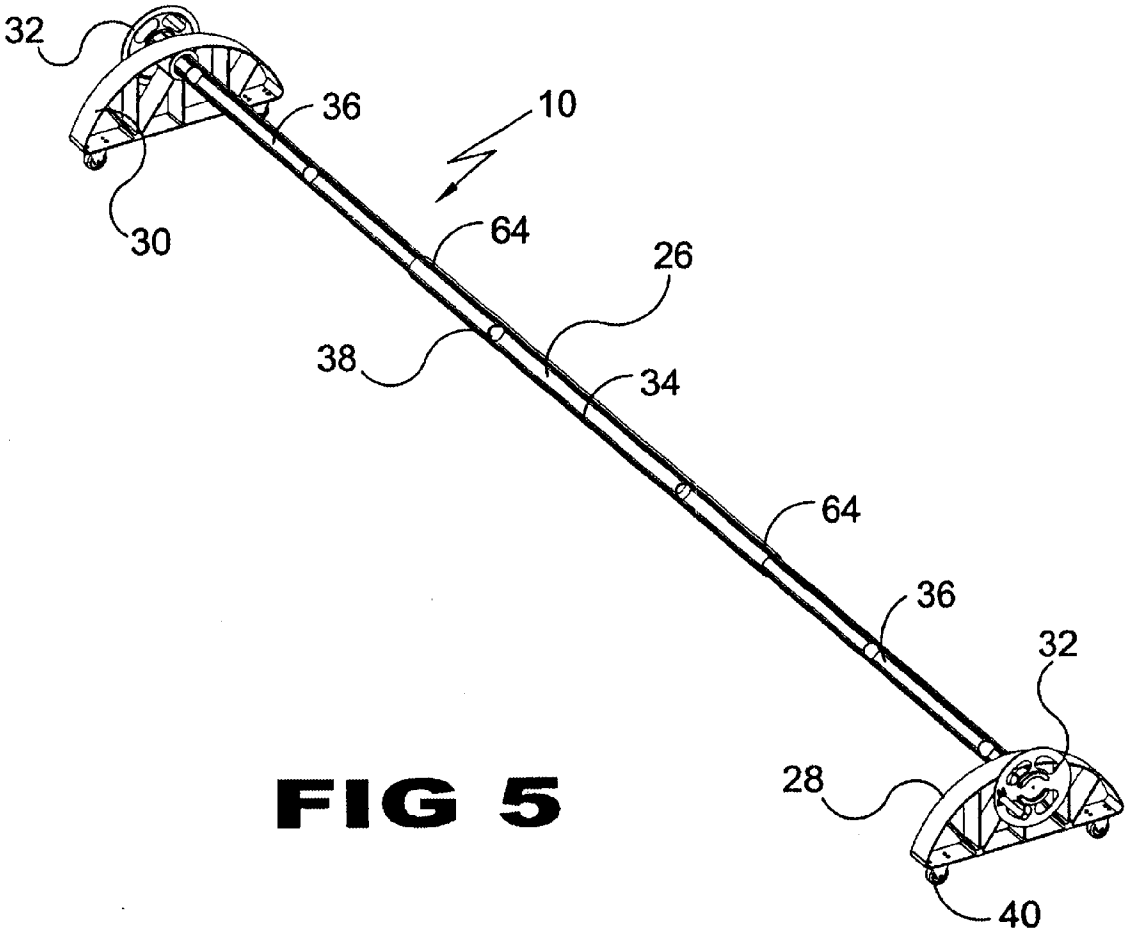
FIG. 5 is a perspective view of the pool cover reel.

Turning to FIG. 5, shown therein is a perspective view of the pool cover reel of the present invention 10. The two supporting end heads, right 28 and left 30, and the connecting tube assembly 26 form the pool cover storage assembly. The hand wheels 32 are rotationally attached to the end heads 28, 30 having multiple caster wheels 40 thereon. The tube assembly 26 comprises one center tube 34 and two end tubes 36. Cotter pins 64 are installed at each end of the center tube 34 for even weight distribution of solid safety cover 66 and to provide a rigid tube assembly 26 as the cover is being rolled up. Cotter pins 64 must be installed through the center of the inverted splines 48 to ensure nothing protrudes above the surface of the tube. The tube assembly 26 is used to store one set of the safety springs of a pool cover before the cover is rolled around the tube assembly. A plurality of storage holes 38 are bored in the tubes for such a use.

Figure 6:
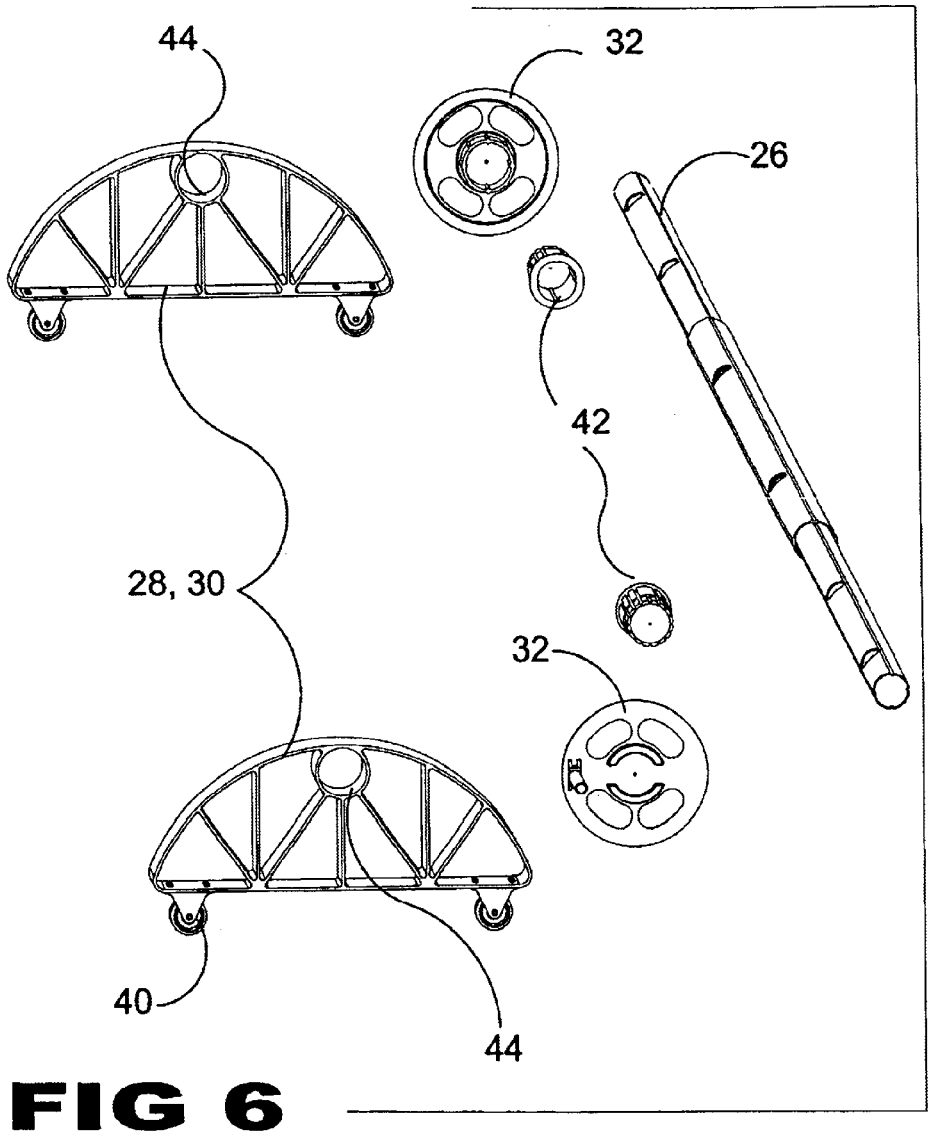
FIG. 6 is an exploded view of the pool cover reel.

Turning to FIG. 6, shown therein is an exploded view of the pool cover reel of the present invention. The end caps 42 are secured to the ends of the tube assembly 26, which are then inserted into the horizontally disposed sleeves 44 in the end heads 28, 30 with caster 40. The end caps 42 protrude out of the end head sleeve 44 to receive the hand wheels 32. The hand wheels 32, end caps 42 and the tube assembly 26 form a rotationally rigid body which forms a reel upon which the pool cover is wound.

Figure 7:
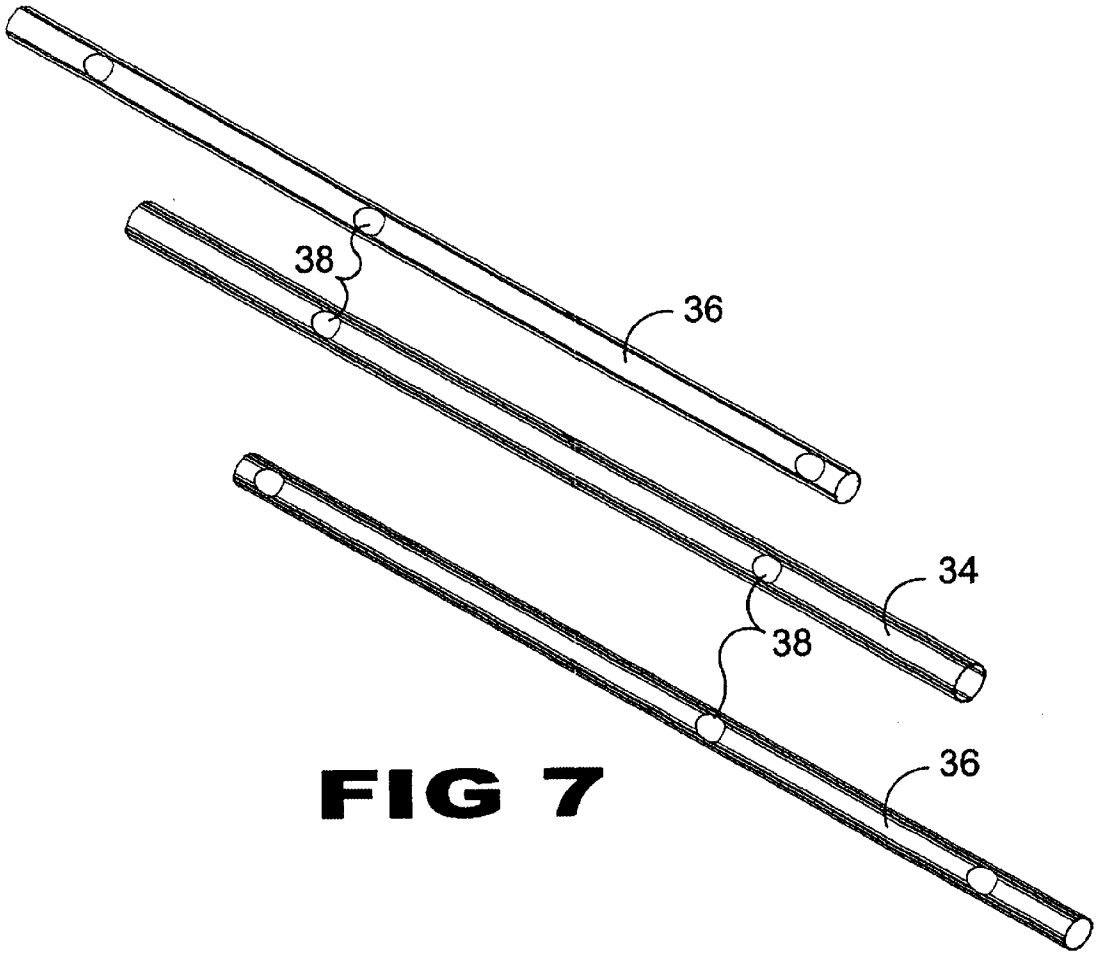
FIG. 7 is an exploded isometric view of the telescoping tubes.

Turning to FIG. 7, shown therein is an exploded isometric view of the telescoping tubes 34, 36. The three part tube assembly provides for selective adjustment of the tube length to fit various sized pool covers. The larger diameter tube is positioned and used as the center tube 34, while the two smaller tubes 36 are inserted into each end of the center tube 24 for selective adjustment to the size of the pool cover. The multiple storage holes 38 are also shown.

Figure 8:
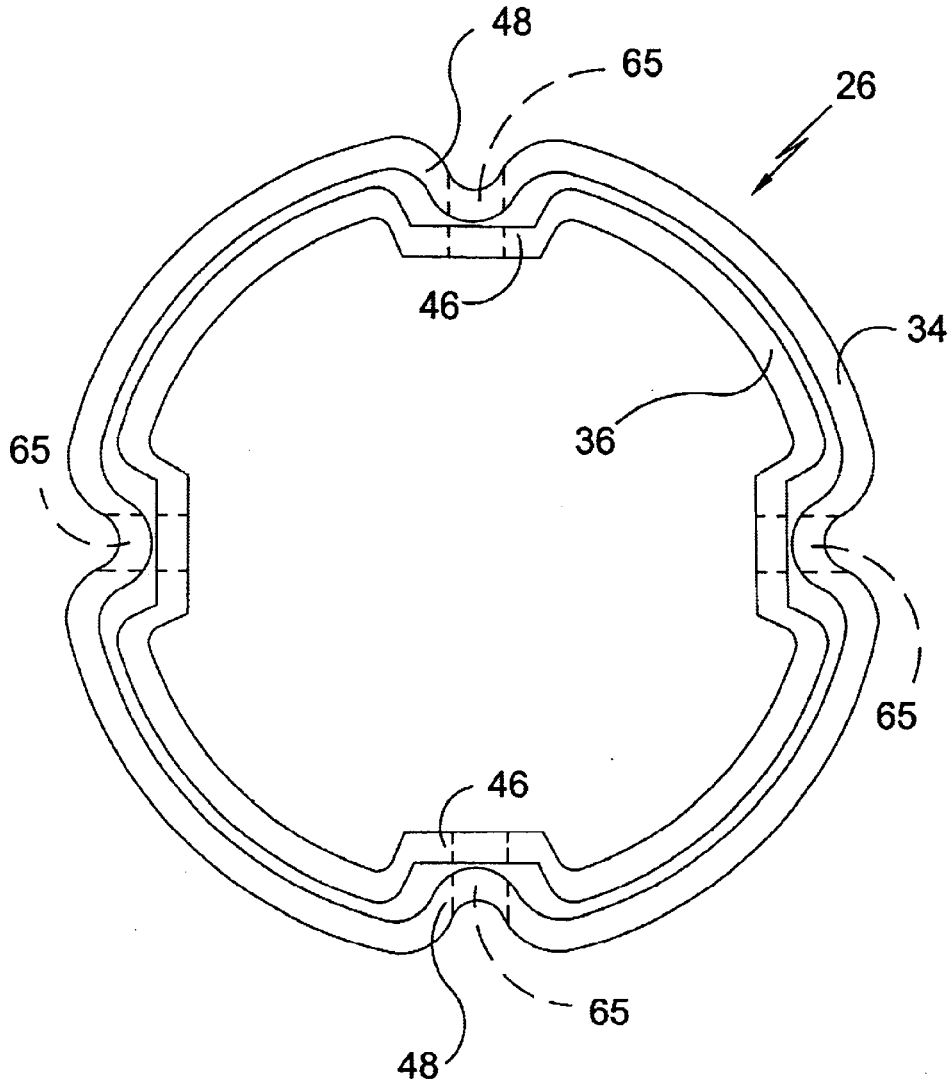
FIG. 8 is an end view of the tube assembly.

Turning to FIG. 8, shown therein is an end view of the tube assembly 26. Multiple female 46 and male 48 extrusions which mate along the surfaces of the telescoping tubes 34, 36 provide a keyway for laterally inserting and extending the tubes to a selective length. In addition, the extrusions 46, 48 ensure joint rotational movement and keep the storage holes properly aligned. Cotter pins 64 are installed into cotter pin apertures 65 at each end of the center tube 34 for even weight distribution of solid safety cover 66 and to provide a rigid tube assembly 26 as the cover is being rolled up. Cotter pins 64 must be installed through the center of the inverted splines 48 to ensure nothing protrudes above the surface of the tube.

Figure 9:
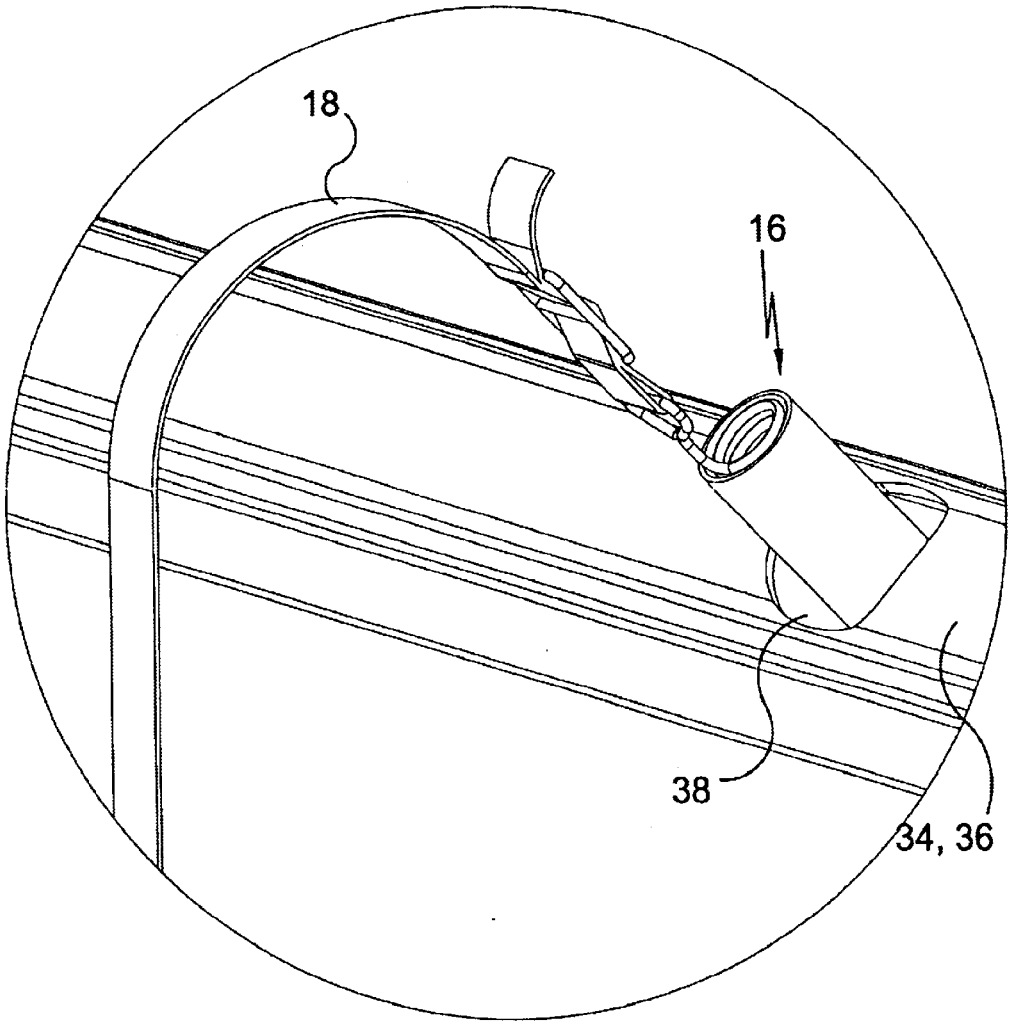
FIG. 9 is a perspective view of the pool cover anchor straps.

Turning to FIG. 9, shown therein is a perspective view of the pool cover anchor straps 18. Depicted is the pool cover anchor springs 16 being inserted through hole 38 into a telescoping tube 34, 36. The inner cavity provides a convenient and efficient means to store the springs 16 at the end of the cover.

Figure 10:
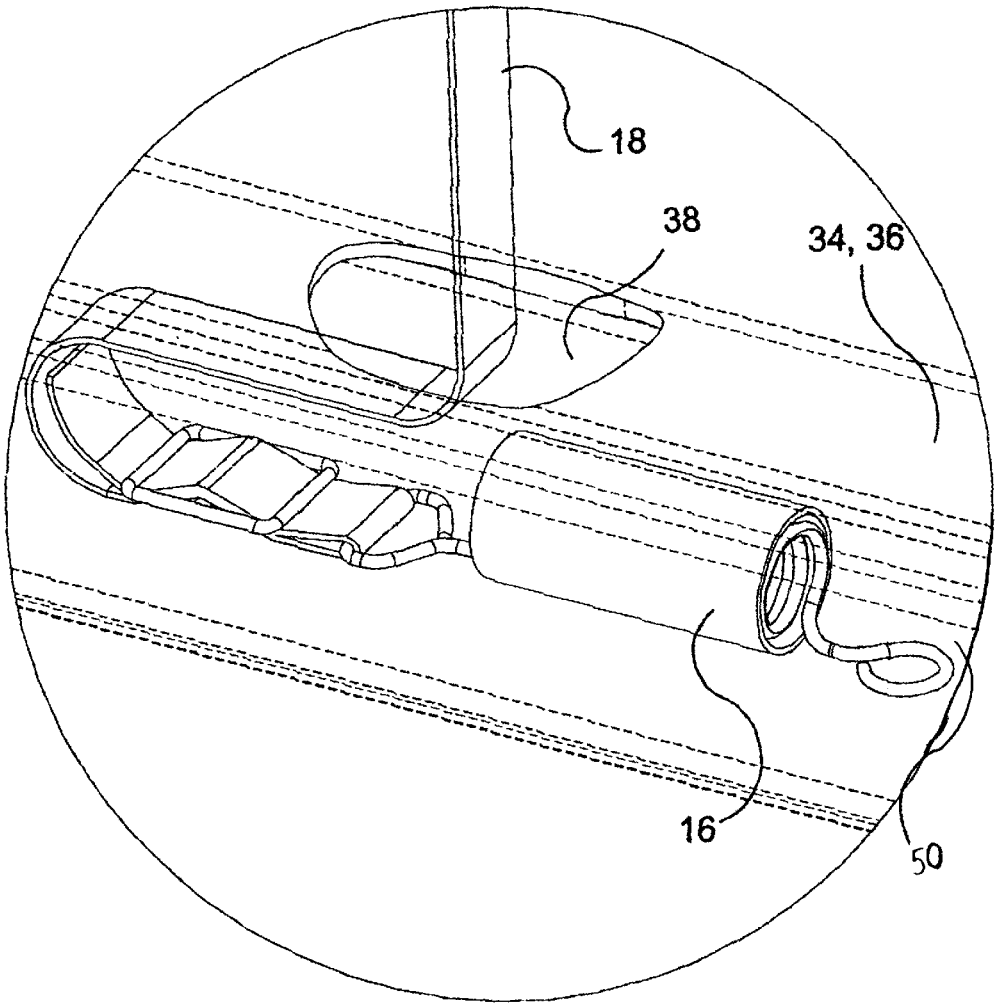
FIG. 10 is a perspective view of a stored pool cover anchor strap.

Turning to FIG. 10, shown therein is a perspective view of a stored pool cover anchor strap 18. Depicted is the pool cover anchor springs 16 stored within the cavity 50 of the telescoping tubes 34, 36. Ideally the holes 38 are elongated to provide case of insertion of the springs 16, as well as chamfered or affixed with a rubber grommet to ensure safety.

Figure 11:
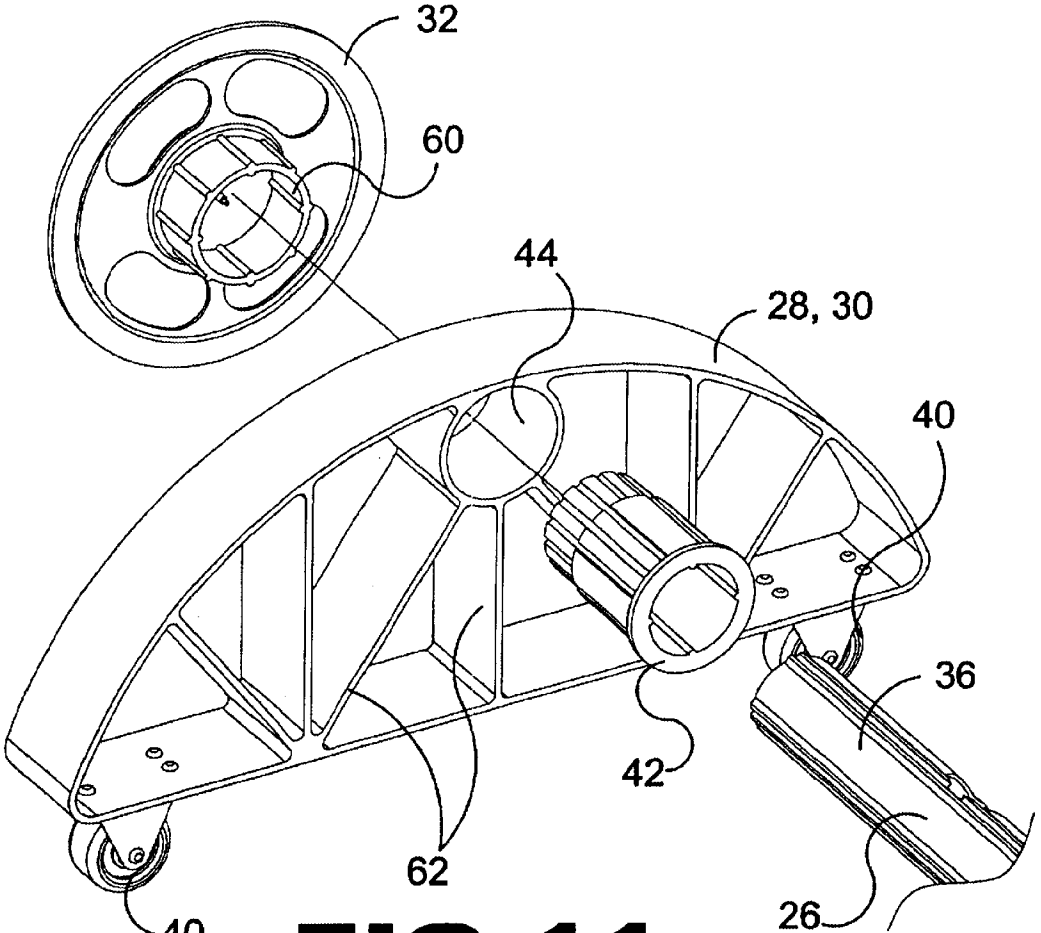
FIG. 11 is an exploded isometric view of the end head assembly.

Turning to FIG. 11, shown therein is an exploded isometric view of the semi-circular end head 28, 30 assembly. The cylindrical bearing surface of the end cap sleeve 44 allows the tube assembly 26 to revolve with a smooth rotation. Shown are hand wheel 32, end cap 42, end tube 36, and casters 40. Centrally disposed recess 60 for receiving the end of the end cap 42 is also shown. Also shown are a plurality of supporting frame members 62 which provide strength to the end head 28, 30 as does the semi-circular shape of the end head.

Figure 12:
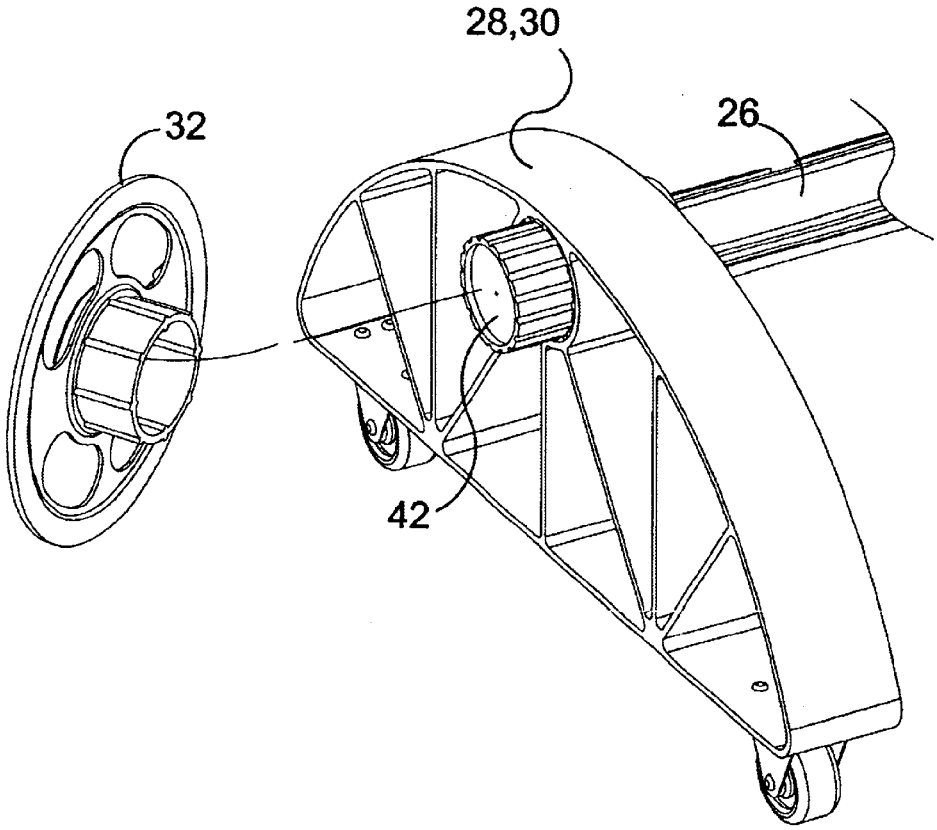
FIG. 12 is a perspective view of the end head assembly with hand cranks removed.

Turning to FIG. 12, shown therein is a perspective view of the end head 28, 30 assembly with hand cranks removed. The cylindrical bearing surface of the end cap sleeve allows the tube assembly 26 to revolve with a smooth rotation. The hand wheel 32 anchors the tube end cap 42 and secures the assembly.

Figure 13:
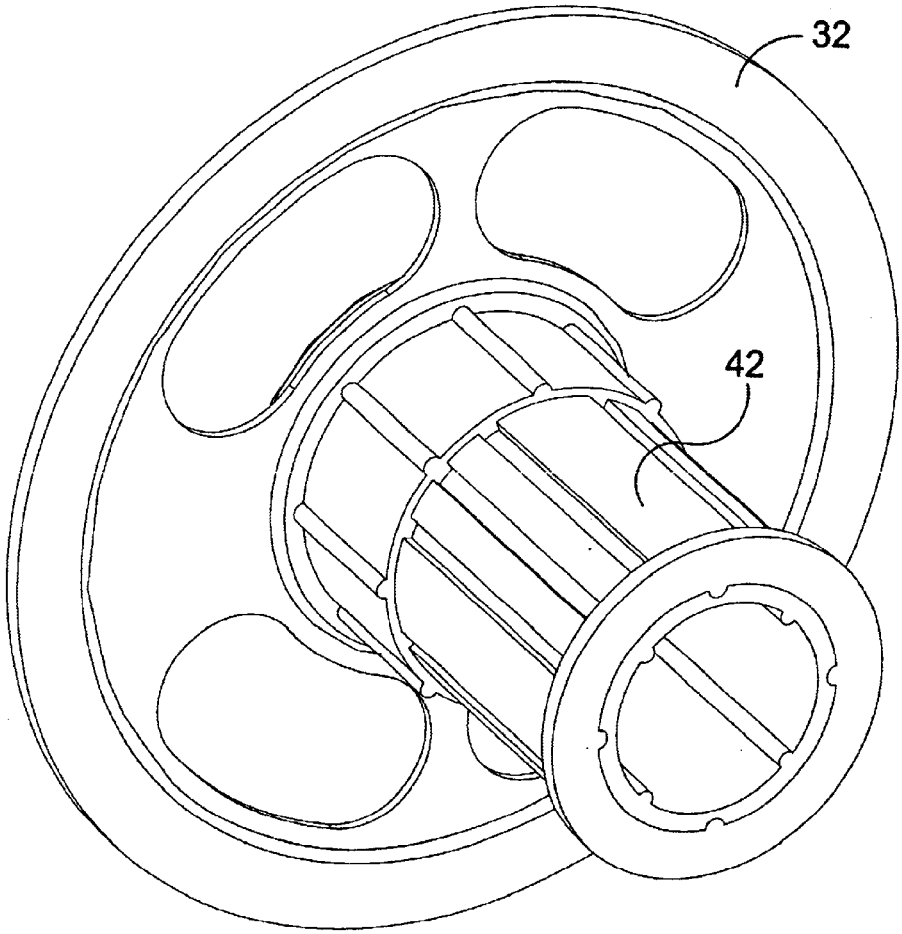
FIG. 13 is an isometric view of the hand wheel and end cap assembly.

Turning to FIG. 13, shown therein is an isometric view of the hand wheel 32 and end cap 42 assembly. The hand wheel 32 and end cap 42 are easily assembled and provide the support for the cross member tube assembly.

Figure 14:
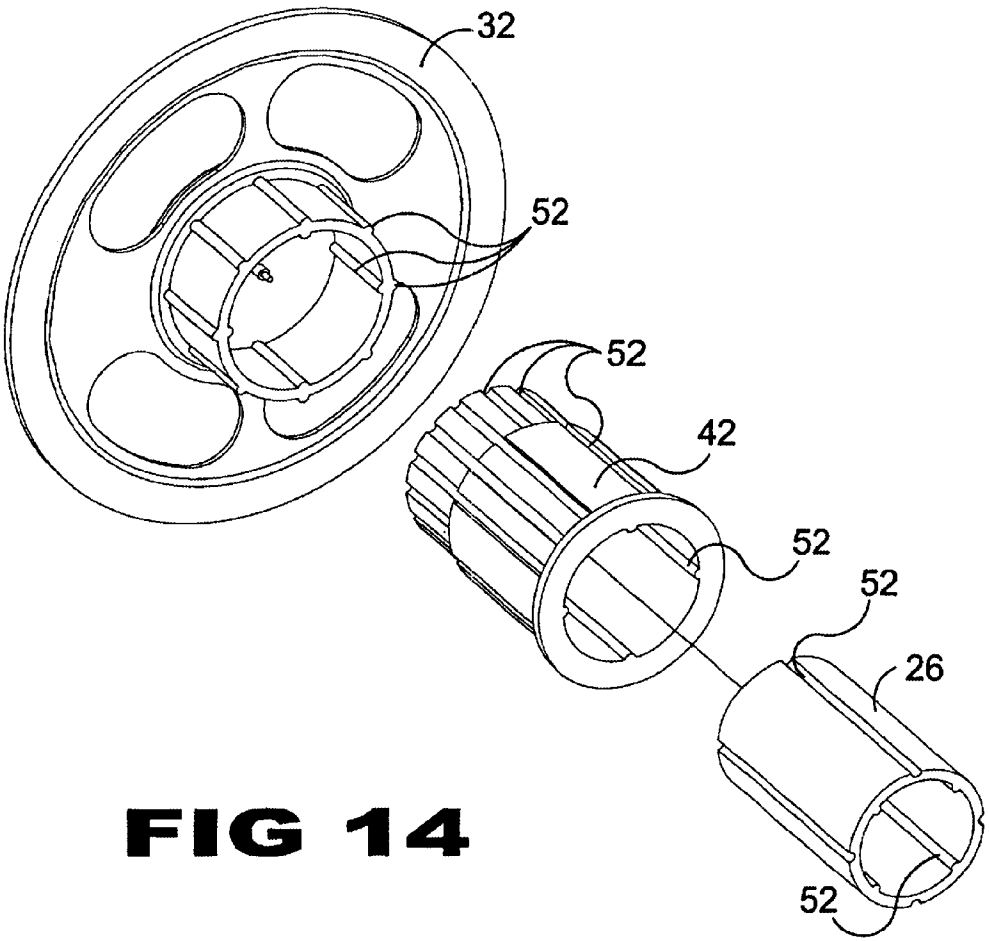
FIG. 14 is an exploded isometric view of the hand wheel and tube assembly.

Turning to FIG. 14, shown therein is an exploded isometric view of the hand wheel 32 and tube assembly 26. The mating longitudinally disposed extruded contours 52 of the hand wheel 32, end cap 42 and tube 26 provide for a rotationally rigid body while allowing for easy axial connection and separation.

Figure 15:
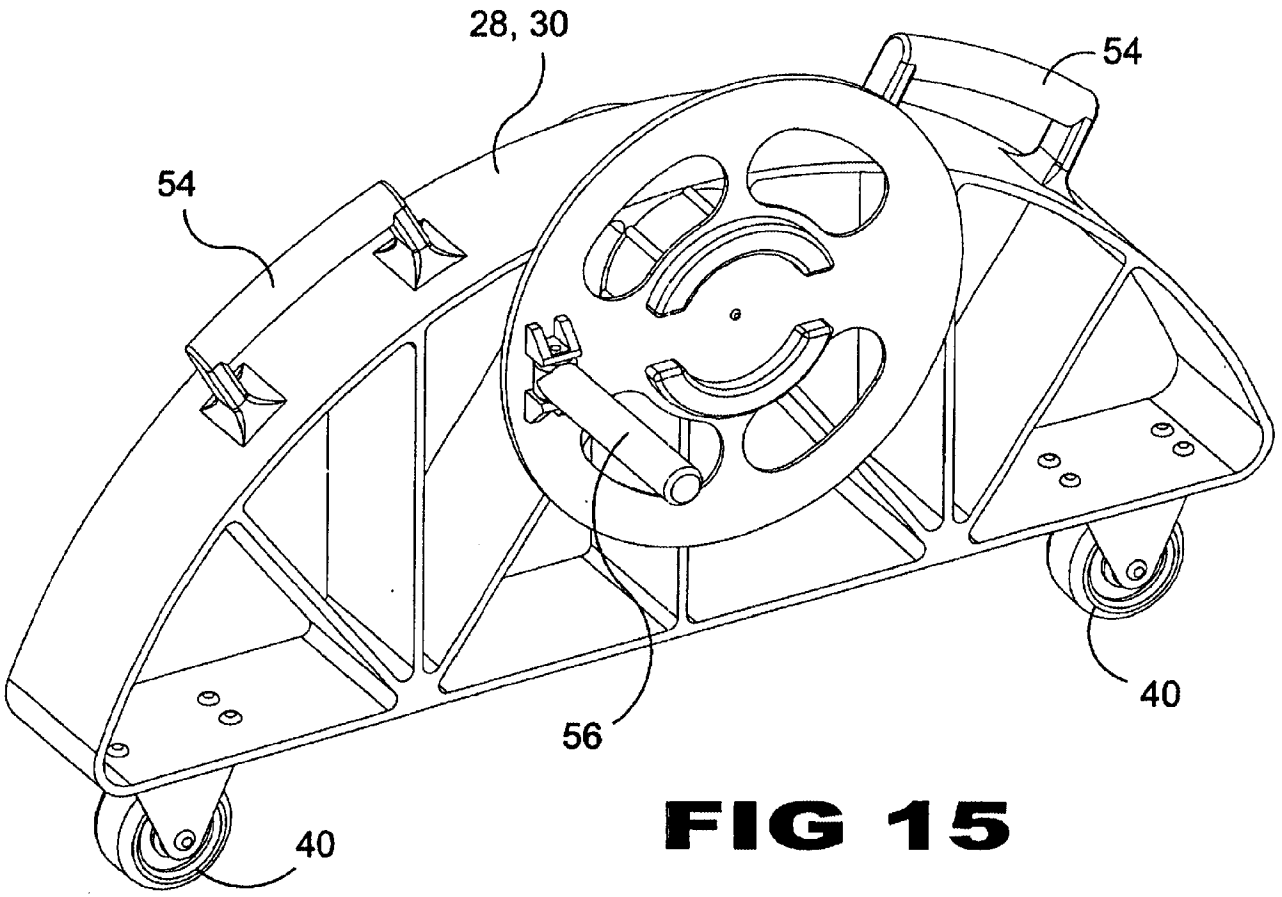
FIG. 15 is a perspective view of an end head assembly.

Turning to FIG. 15, shown therein is a perspective view of an end head 28, 30 assembly. The end head 28, 30 assembly includes casters 40 to allow for transport and ease of movement of the pool cover into proper position. As an additional element, handles 54 can be affixed to the top surface of the end head 28, 30 to enhance handling. A hand crank 56 is also shown.

Figure 16:
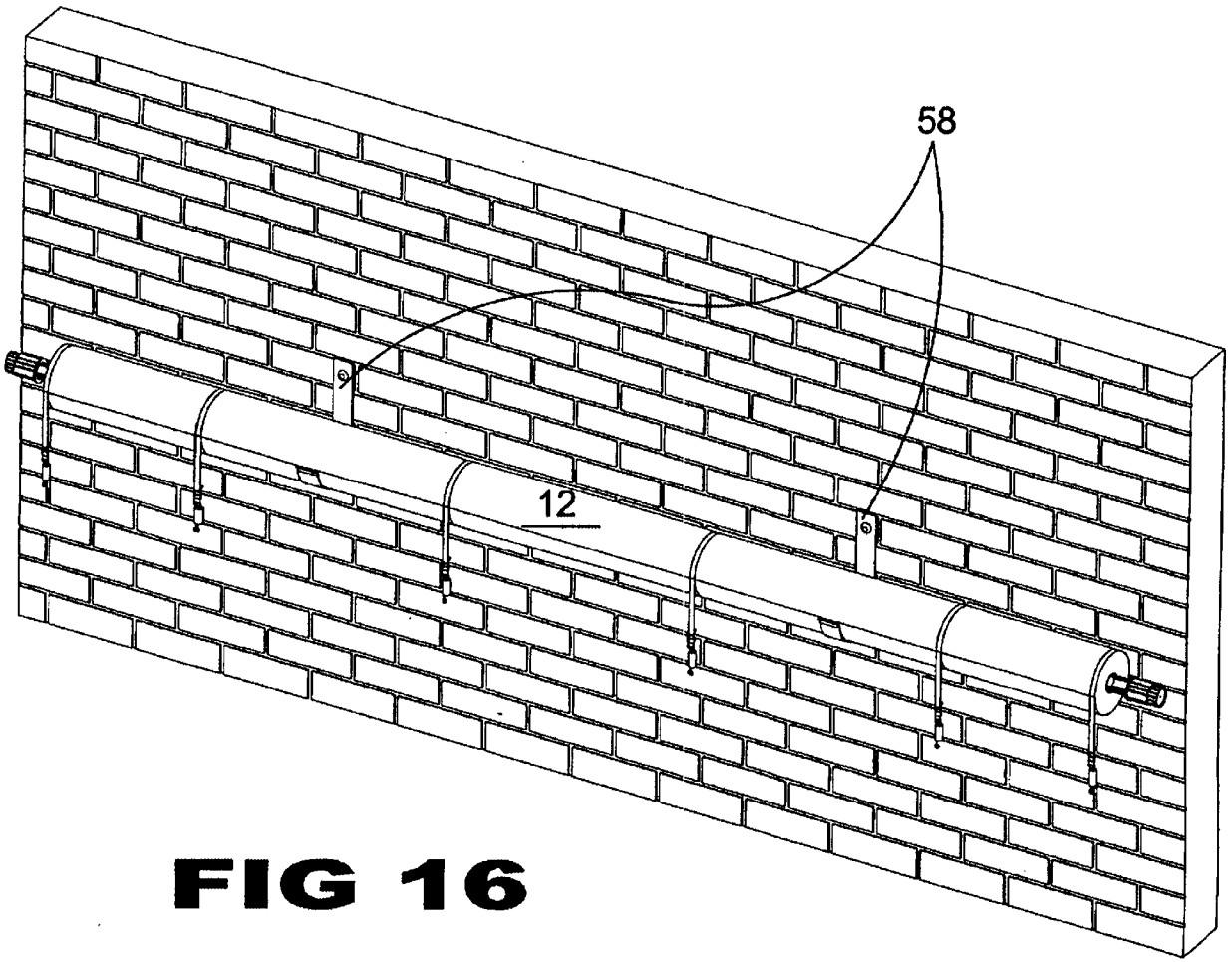
FIG. 16 is a perspective view of the pool cover in storage.

Turning to FIG. 16, shown therein is a perspective view of the pool cover 12 in storage. The rigidity of the tube assembly provides support for the pool cover 12 during storage and can be easily suspended from a proximate object using hangers 58 with fasteners thereby extending the life cycle of the pool cover as well as providing a neat appearance of the pool cover during storage.

Figure 17:
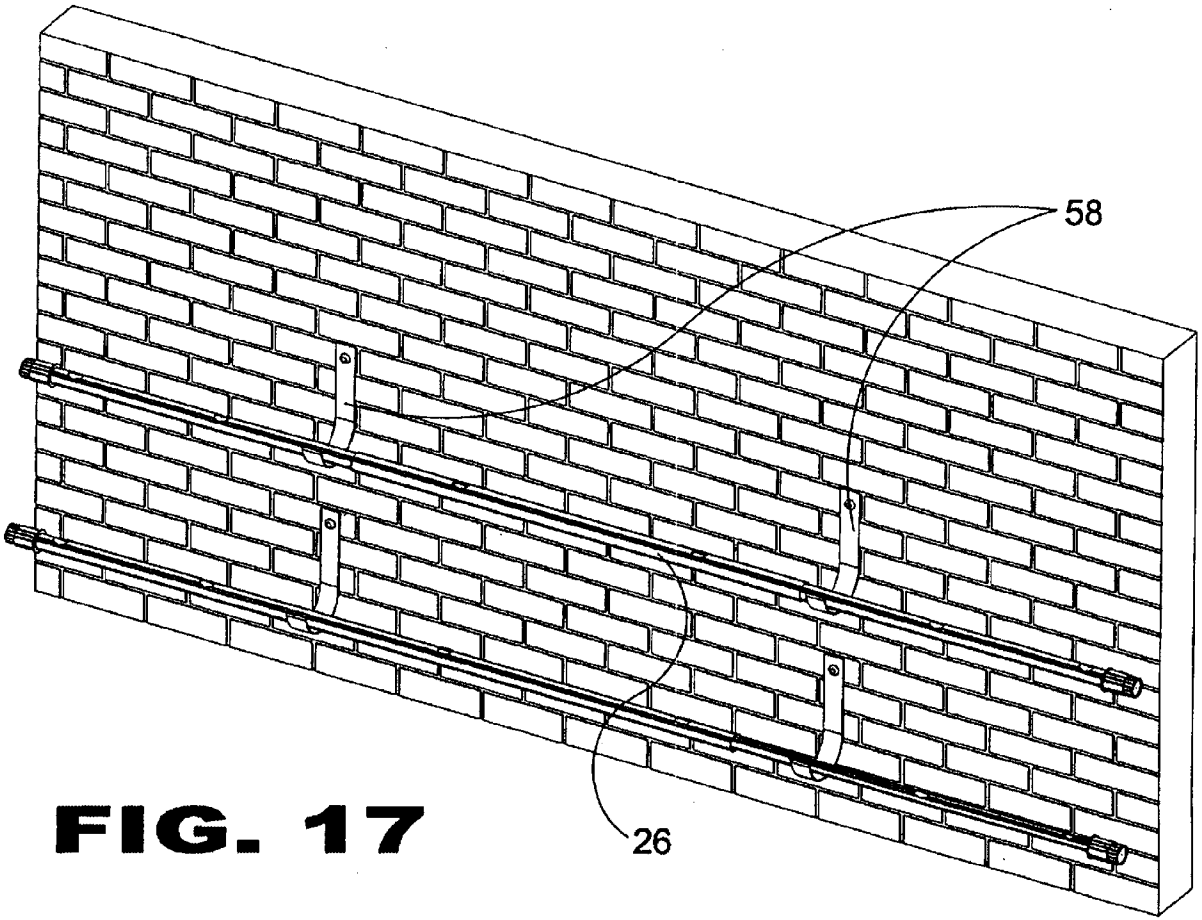
FIG. 17 is a perspective view of the telescoping tubes in storage.

Turning to FIG. 17, shown therein is a perspective view of the telescoping tube assembly 26 in storage. The telescoping tubes are rigid and can be stored in the same configuration as when stored with the cover assembly. Hangers 58 are also shown. By maintaining the outside dimensions of the end cap 42 and either supplying various bore diameters to suit the smaller solar blanket tubes, or using adapter bushings, both a solid safety cover tube assembly and a solar blanket tube assembly can be used with the same end heads 28, 30 for installation or removal.

Figure 18:
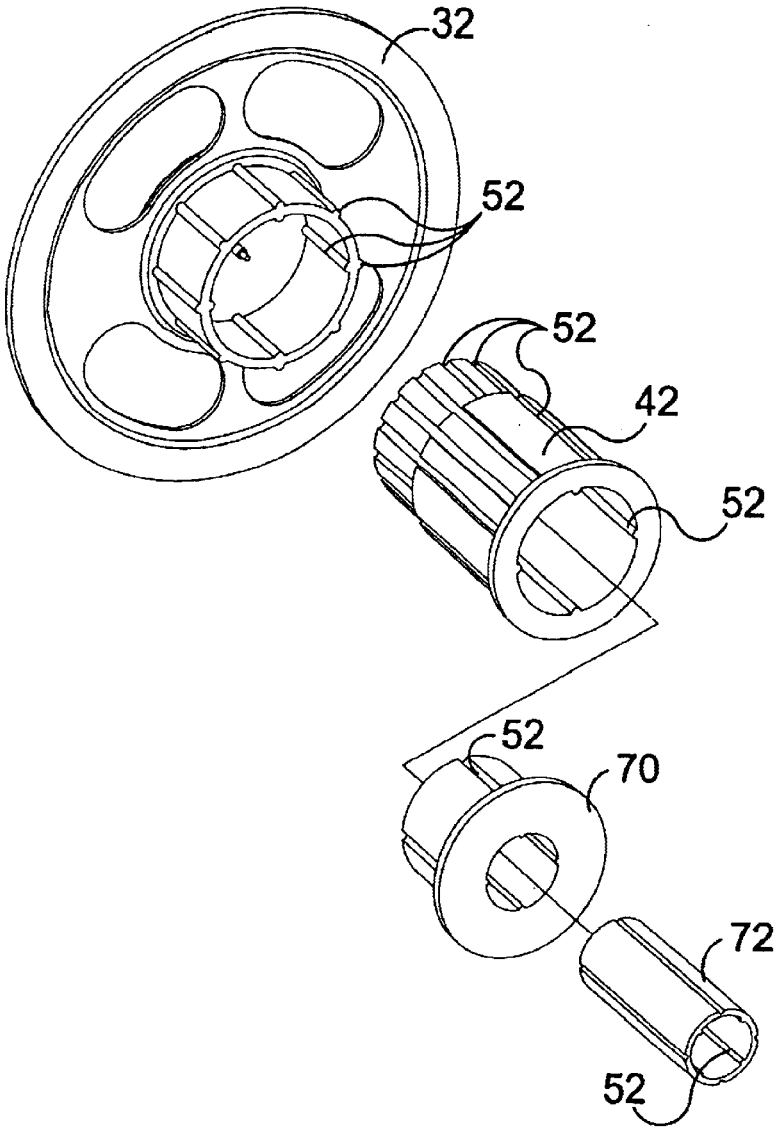
FIG. 18 is an exploded isometric view of the hand wheel, adaptor bushing and small diameter tube assembly.

Turning to FIG. 18, shown therein is an exploded isometric view of the hand wheel 32 and tube assembly 26 with end cap 42 modified with an adaptor bushing 70. The mating longitudinally disposed extruded contours 52 of the hand wheel 32, end cap 42, and adaptor bushing 70, and tube 26 provide for a rotationally rigid body while allowing for easy axial connection and separation. The adapter bushing 70 provides means to maintain the outside dimensions of the end cap 42 and attach a smaller diameter tube 72 for use with installation and removal of a solar cover 68.

What is claimed to be new and desired to be protected by Letters Patent is set forth in the appended claims:

1. In combination, a swimming pool cover and apparatus for storing said swimming pool cover thereon, comprising:

a) an elongated rotating tube assembly, said tube assembly having a pair of ends, said tube assembly being substantially horizontally disposed for having a swimming pool cover wound thereon, said pool cover having a plurality of straps thereon and a plurality of springs thereon, wherein said straps and springs are for attachment to a plurality of anchors spaced about a deck of a swimming pool so that the pool cover can be secured to the swimming pool;

b) a pair of supporting end heads, each end head for receiving one end of said tube assembly to permit the tube assembly to be supported by the pair of end heads, wherein each end head has a horizontally disposed sleeve therein, wherein each end head is further defined by a top and a bottom;

c) a pair of end caps, wherein each said end cap has a first end and a second end, said first end of said end cap being disposed on each end of said tube assembly, wherein each of said second ends of said end caps passes through said sleeve of said end head and protrudes outwardly through each of said end heads;

d) a pair of hand wheels, each of said hand wheels being disposed on each of said second ends of said end caps, wherein said hand wheel has an inwardly extending centrally disposed recess for receiving each of said end caps;

e) a hand crank disposed on each of said hand wheels to permit a user to turn said tube assembly; and, f) means for rotationally securing said tube assembly, said end caps, and said hand wheels to each other so that the tube assembly rotates with the hand wheels, wherein said tube assembly comprises a center tube and a pair of end tubes disposed on each end of said center tube, wherein said center tube is larger in diameter than said pair of end tubes so as to operate telescopically to permit the length of the tube assembly to be varied to accommodate varying sizes of swimming pool covers and said means for rotationally securing said tube assembly comprises:

a) mating longitudinally disposed extrusions disposed in said center tube and said pair of end tubes;

b) mating longitudinally disposed extrusions disposed on said first end of said end cap and said ends of said pair of end tubes; and, c) mating longitudinally disposed extrusion disposed on said second end of said end caps and said recess of said hand wheel.

2. The apparatus of claim 1, wherein said tube assembly has a plurality of holes therein, said holes being disposed in the wall thereof, said holes for receiving the springs of the pool cover to permit the springs to be stored on the inside of the tube assembly.

3. The apparatus of claim 2, wherein said holes are substantially elongated longitudinally along said tube assembly to permit easy insertion of the springs therein.

4. The apparatus of claim 3, further comprising at least one handle disposed on said top of said end head to permit the end heads to be easily moved about.

5. The apparatus of claim 4, further comprising a pair of casters disposed on said bottom of said end head to permit the end heads to be easily moved about.

6. The apparatus of claim 5, further comprising a pair of hangers for attachment to said tube assembly to permit the tube assembly to be attached to a proximate object.

7. The apparatus of claim 6, further comprising fasteners for attaching said hangers to a proximate object to permit the tube assembly to be attached to a proximate object.

8. The apparatus of claim 7, wherein said end heads are semi-circular in shape to provide great structural strength.

9. The apparatus of claim 8, wherein said end heads further comprise supporting frame members disposed between said top and said bottom thereof to provide great structural strength.

10. The apparatus of claim 9, wherein said extrusions on said center tube are inwardly extending male protrusions and said extrusions of said end tubes are inwardly extending female protrusions for receiving said male protrusions to permit the tubes to be rotationally secured to each other.

* * * * *